United States Patent [19]

Pelavin et al.

[11] 4,004,664

[45] Jan. 25, 1977

[54] FRAME CONSTRUCTION FOR LUGGAGE

[75] Inventors: Joseph Y. Pelavin, North Bergen, N.J.; Seymour Spiegelman, Whitestone, N.Y.; John S. Rastocny, Cliffside Park, N.J.

[73] Assignee: Lark Luggage Corporation, New York, N.Y.

[22] Filed: Apr. 21, 1976

[21] Appl. No.: 679,123

[52] U.S. Cl. ..... 190/49

[51] Int. Cl.[2] ..... A45C 13/36

[58] Field of Search ..... 190/21, 24, 44, 49, 190/50

[56] References Cited

UNITED STATES PATENTS

| | | | |
|---|---|---|---|
| 2,002,878 | 5/1935 | Belber | 190/44 |
| 2,788,871 | 4/1957 | Arlitt | 190/49 |
| 3,291,267 | 12/1966 | Pelavin | 190/49 |

*Primary Examiner*—Donald F. Norton
*Attorney, Agent, or Firm*—Blum Moscovitz Friedman & Kaplan

[57] ABSTRACT

An article of luggage which includes a luggage case having a peripheral side wall which is made of a flexible material. In order to impart some degree of rigidity to this flexible side wall, a frame structure is situated in the interior of the luggage case and extends along the inner surface of the side wall thereof. This frame structure has at each of a plurality of regions thereof a pair of frame portions which are substantially rigid and which terminate in free ends which are spaced from and directed toward each other. This frame structure also includes at each of the above regions thereof a spring construction which is operatively connected with the frame portions for acting on the latter to urge them apart from each other so as to tend to increase the distance between the free ends thereof. Thus, the substantially rigid frame portions are pressed by the spring means against the inner surface of the side wall of the luggage casing to impart a certain degree of rigidity to the side wall. At the same time, because of the presence of this spring construction it is possible for the luggage casing to resiliently yield when encountering impacts, crushing forces, or the like, with the spring construction returning the parts to their original condition when these impacts, crushing forces, and the like no longer act on the article of luggage.

12 Claims, 7 Drawing Figures

FIG. 4
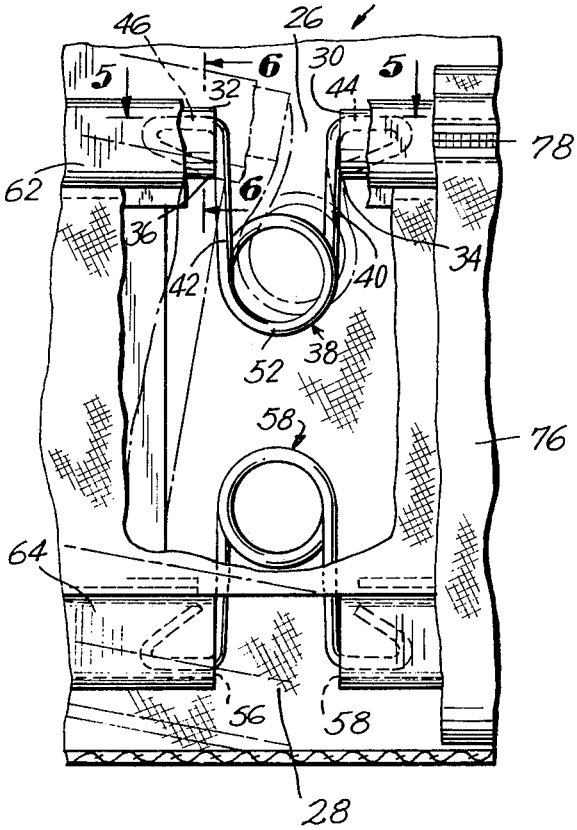
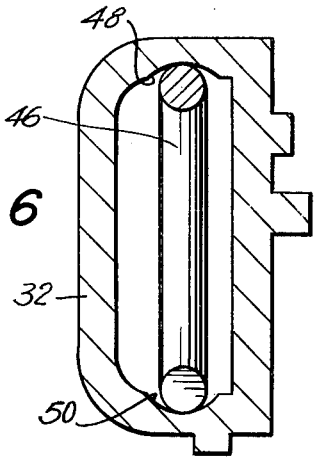
FIG. 6
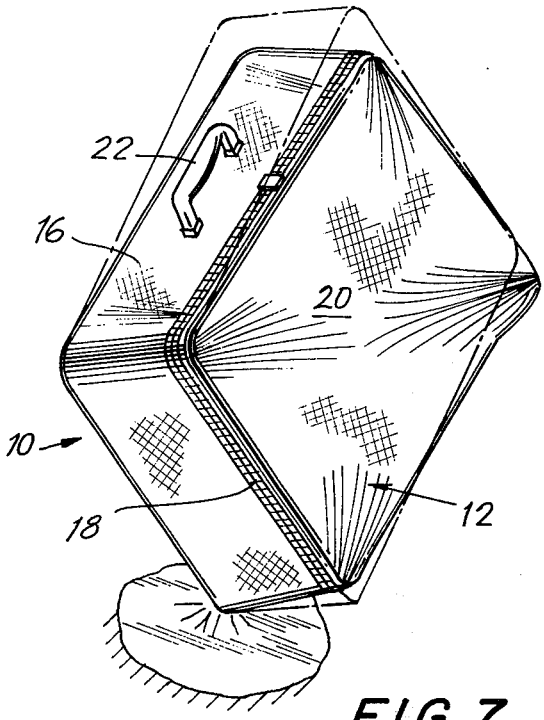
FIG. 7
FIG. 5
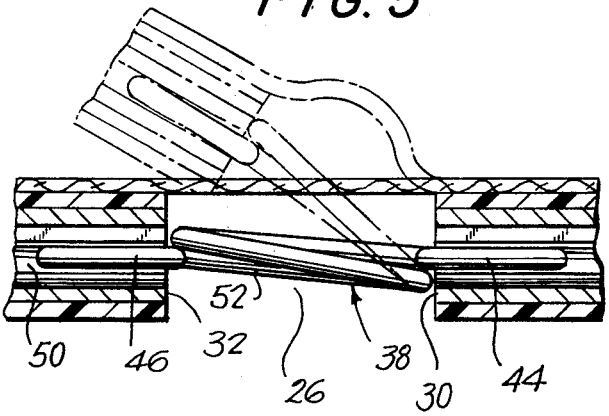

FRAME CONSTRUCTION FOR LUGGAGE

BACKGROUND OF THE INVENTION

The present invention relates to luggage.

In particular, the present invention relates to so-called soft-sided luggage according to which the luggage casing is made of a flexible sheet material such as a suitable fabric, plastic, or the like. Such soft-sided luggage is highly favored because of its light weight and low cost. In order to give luggage of this type a certain dimensional stability and shape-retaining capability, the flexible sheet material which forms the luggage case is generally supported by a metal framework.

One of the serious drawbacks encountered with luggage of this type is that due to the rough handling normally encountered by luggage, during which the luggage is subjected to impacts, crushing forces, and the like, the metal framework is easily bent out of shape. As a result luggage of this type does not have a long useful life.

SUMMARY OF THE INVENTION

It is accordingly a primary object of the present invention to provide luggage of the above general type which is capable of withstanding impacts, crushing forces, and the like, without becoming permanently distorted and without detracting from the subsequent full enjoyment of the luggage.

Thus, it is an object of the present invention to provide for so-called soft-sided luggage a construction according to which a certain degree of rigidity is imparted to the luggage while at the same time the luggage is capable of temporarily yielding to impacts, crushing forces, and the like with the luggage being capable of effectively resuming its initial condition when the forces which tend to distort the luggage are no longer active.

It is moreover an object of the present invention to provide a construction of this type which will retain such features as the low weight and relatively low cost of the luggage.

In addition it is an object of the present invention to provide a construction of this type which is relatively simple and composed of parts which are easy to manufacture and assemble. Furthermore, it is an object of the present invention to provide an article of luggage wherein the structure of the invention which gives the luggage its desired characteristics does not require any excessively large space, so that almost the entire interior space of the luggage case is available for receiving articles which are to be carried by the luggage.

According to the invention the article of luggage has a luggage case provided with a peripheral side wall which is made of a flexible sheet material. This side wall has directed toward the interior of the luggage case an inner surface along which a frame means of the invention extends. This frame means includes at each of a plurality of regions thereof a pair of substantially rigid frame portions which respectively terminate in free ends which are spaced from and directed toward each other. A spring means is operatively connected to these frame portions for urging them apart from each other so as to tend to increase the distance between the free ends thereof. The nature of this spring means is such that when the article of luggage is subjected to impacts, crushing forces and the like, it is possible for the frame means to yield resiliently while restoring the frame means and the article of luggage to its initial condition upon termination of the impacts, crushing forces, and the like.

BRIEF DESCRIPTION OF DRAWINGS

The invention is illustrated by way of example in the accompanying drawings which form part of this application and in which:

FIG. 4 is also a fragmentary sectional illustration, at an enlarged scale as compared to FIG. 2, showing further details of the structure of FIG. 2, FIG. 4 being taken along line 4—4 of FIG. 2 in the direction of the arrows;

FIG. 5 is a fragmentary sectional plan view taken along line 5—5 of FIG. 4 in the direction of the arrows and showing in phantom lines how the structure of the invention operates to achieve the desired results;

FIG. 6 is a transverse section of part of the structure of FIG. 4 taken along line 6—6 of FIG. 4 in the direction of the arrows and showing the structure at a scale which is enlarged as compared to FIG. 4; and FIG. 7 illustrates how the luggage of the invention behaves when subjected to an impact at a corner of the article of luggage.

DESCRIPTION OF PREFERRED EMBODIMENTS

Figure 1:
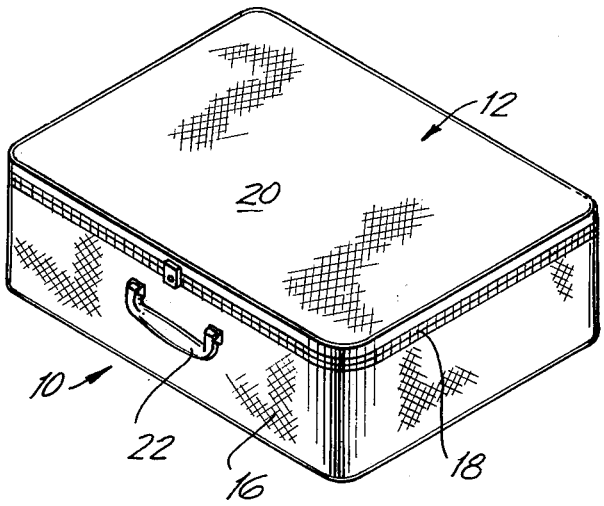
FIG. 1 is a perspective illustration of one possible embodiment of an article of luggage according to the invention as the article of luggage appears at the exterior thereof.
Figure 2:
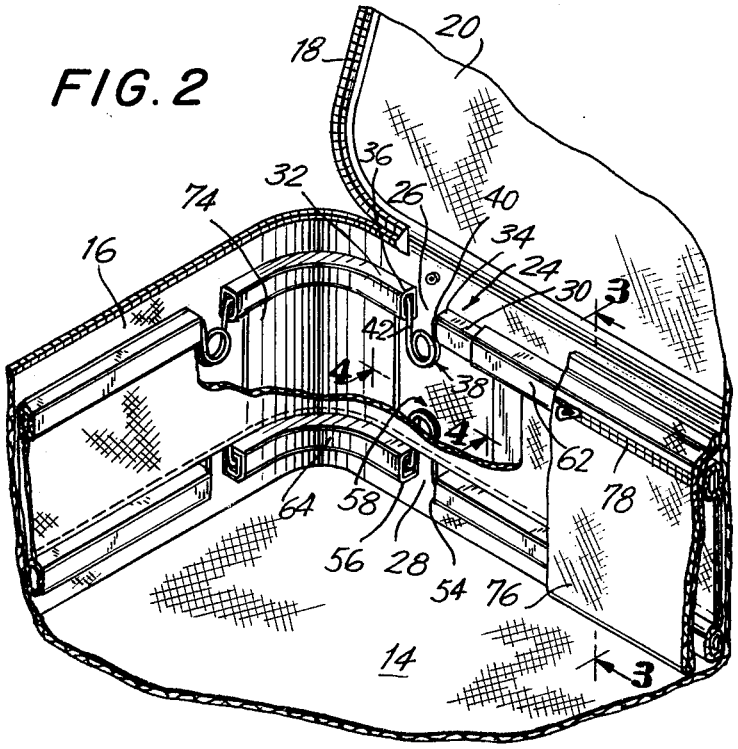
FIG. 2 is a fragmentary partly sectional illustration of the article of luggage of FIG. 1 shown in an open condition with part of the inner structure broken away so as to illustrate the details of the invention.

Referring now to FIG. 1, the article of luggage 10 which is illustrated therein includes a luggage case 12 which is made of a flexible sheet material such as a suitable fabric, for example. The luggage case 12 has a bottom wall 14 (FIG. 2). A peripheral side wall 16 is joined at its lower edge region in a known way to the bottom wall 14 and projects therefrom in the manner apparent from FIG. 2. Through a suitable slide fastener 18 a cover 20 is capable of being closed and opened, this cover 20 being joined to the rear section of the side wall 16 in the manner apparent from FIG. 2. The side wall 16 has a front wall section to which a handle 22 is connected in a conventional manner. Thus, the article of luggage 10 may have either the closed position indicated in FIG. 1 or the open position fragmentarily indicated in FIG. 2.

In order to impart a certain degree of rigidity to the article of luggage, a frame means 24 of the invention is situated next to and extends along the inner surface of the peripheral side wall 16. This frame means 24 has at each of a plurality of regions, such as the regions 26 and 28 shown in FIG. 2, a pair of substantially rigid frame portions 30 and 32 which respectively terminate in free ends 34 and 36 which are spaced from and directed toward each other as illustrated for the region 26 of the frame means 24 in FIG. 2. In the illustrated construction where the peripheral side wall 16 has curved corner sections and straight sections extending between and forming extensions of the curved corner sections, the regions of the frame means, such as the regions 26 and 28, where free ends 34 and 36 of the frame portions 30 and 32, respectively, are situated, are preferably situated at the location where the straight sections join the curved corner sections of the peripheral side wall 16.

The frame portions 30 and 32 are substantially rigid. Thus, these frame portions may take the form of metal extrusions made of aluminum, for example.

According to a further feature of the invention, the frame means 24 includes at each of its regions, such as the regions 26 and 28, a spring means 38 operatively connected with the pair of frame portions 30 and 32 at each region of the frame means for urging the free ends 34 and 36 of the frame portions 30 and 32 apart from each other. Thus, because of the presence of the spring means 38, the several frame portions such as the portions 30 and 32 tend to be urged apart from each other, to tend to increase the distance between the free ends thereof, and thus the frame portions are urged outwardly toward the inner surface of the peripheral side wall 16 to impart a certain degree of rigidity thereto. At the same time, the spring means of the invention operates to oppose twisting movements of the frame portions 30 and 32 one with respect to the other and to oppose displacement of these frame portions 30 and 32 from the condition where the free ends 34 and 36 thereof are directed toward each other.

For this purpose the particular spring means 38 which is illustrated has a pair of legs 40 and 42 which in part extend between the frame portions 30 and 32 engaging the free ends 34 and 36 thereof, respectively. When the spring 38 is in an unstressed condition, the legs 40 and 42 thereof are spaced from each other by a distance greater than the distance between the free ends 34 and 36 of the frame portions 30 and 32. As a result it is necessary to push these legs toward each other, in opposition to the inherent spring force, in order to situate them between the free ends 34 and 36, urging the latter apart from each other.

According to a further feature of the invention the frame portions 30 and 32 are in the form of elongated hollow extrusions so that these frame portions have hollow interiors terminating in openings at the free ends 34 and 36. The legs 40 and 42 of the spring means 38 respectively have extensions 44 and 46 (FIG. 4) which extend through these openings into the hollow interiors of the frame portions 30 and 32. These extensions 44 and 46 have the substantially looped configuration illustrated most clearly in FIG. 4. Each extrusion 30 and 32 is formed at its hollow interior with a pair of opposed longitudinally extending grooves 48 and 50 shown most clearly in FIG. 6 for the extrusion 32. The looped portion 46 forming the extension of the leg 42 is shown in FIG. 6 having opposed portions respectively received in the grooves 48 and 50. In the same way opposed portions of the extension 44 are situated in opposed interior grooves of the extrusion 30. Thus, these extrusions are of a substantially rectangular cross section and have at their opposed upper and lower wall regions the inner grooves 48 and 50 which receive the looped extensions of the legs of the spring means. These legs 40 and 42 of each spring means 38 are substantially coplanar, and because their looped extensions 44 and 46 are maintained in the grooves 48 and 50, the spring means 38 is maintained in the same plane as the frame portions 30 and 32.

It will be seen that the legs 40 and 42 of the spring means 38 extend laterally from the frame portions 30 and 32 and form extensions of an intermediate coiled portion 52 of the spring means 38, this coiled portion including, for example, a single complete convolution from which the legs 40 and 42 extend as illustrated.

As is apparent from the drawings, one series of spaced frame portions, such as that including the frame portions 30 and 32 extends along the inner surface of the peripheral casing side wall 16 adjacent an upper edge region of the latter, while a second series of frame portions which may be identical with the upper series extend along the inner surface of the side wall 16 adjacent the lower edge region thereof which is joined to the bottom wall 14 of the casing 12. Thus, at the region 28 there are a pair of frame portions 54 and 56 identical with and corresponding to the frame portions 30 and 32, respectively, and interconnected by way of second spring means 58 identical with the spring means 38. However, it will be seen that the pair of spring means 38 and 58 project laterally in opposite directions from the regions 26 and 28 where they are operatively connected with the frame portions so that the pair of spring means 38 and 58 project toward each other as illustrated in FIGS. 2 and 4.

Figure 3:
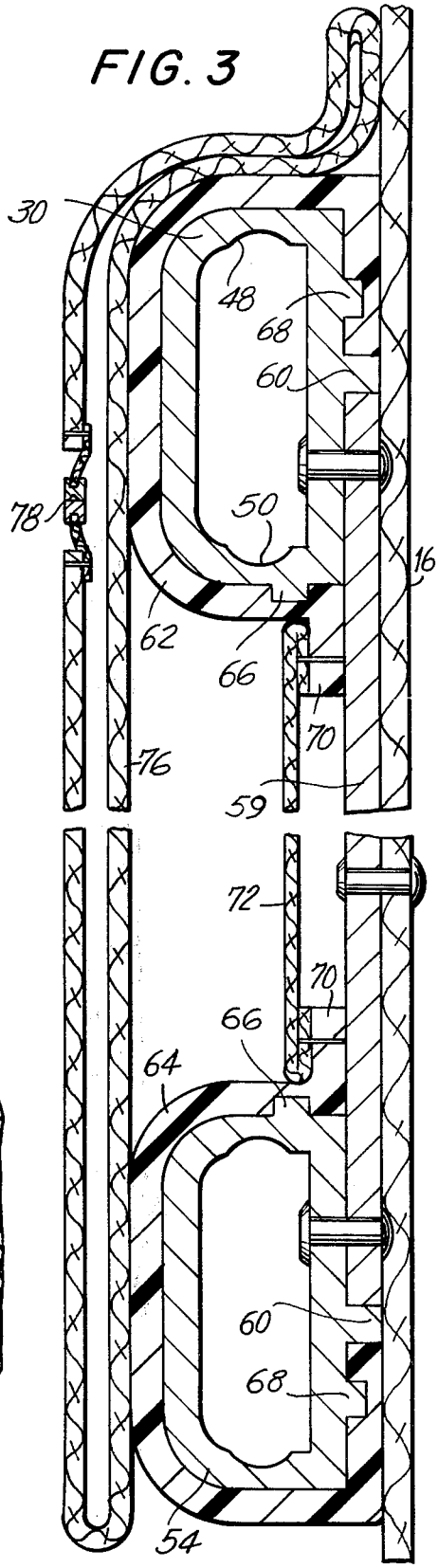
FIG. 3 is a fragmentary sectional elevation of part of the structure shown in FIG. 2, taken along 3—3 of FIG. 2 in the direction of the arrows and showing the structure at a scale which is enlarged as compared to FIG. 2.

The series of frame portions which are situated respectively along the upper and lower edge regions of the side wall 16 are interconnected with each other by way of suitable spacer plates 59 which are riveted to the frame portions in the manner apparent from FIG. 3 and which are spaced from each other and distributed along the inner surface of the side wall 16. At their outer exterior surfaces the substantially rigid frame portions, such as the frame portions 30 and 32 have outwardly directed ribs 60 engaging opposed edges of the spacer plates 59. In addition, the several frame portions of the frame means are encased within plastic covering extrusions such as the extrusions 62 and 64 illustrated in FIG. 3 for the frame portions 30 and 54. These plastic extrusions which cover the substantially rigid frame portions are formed with grooves which receive ribs such as the ribs 66 and 68 of the frame portions, so that the plastic coverings 62, 64, etc. are maintained in a proper position with respect to the substantially rigid metal frame portions. The plastic extrusions may be made of any suitable plastic such as polyvinyl chloride, for example, and terminate in lips 70 which are sewn to fabric covering sheet material 72 which thus lines the interior of the luggage casing at the peripheral side wall thereof, this fabric covering extending across the parts of the several spring means which project laterally from the substantially rigid frame portions. The metal spacer plates such as the plate 59 in FIG. 3 are suitably riveted to the peripheral side wall 16 as shown in FIG. 3.

It will be understood that a construction as described above and shown at the region 26 is also situated at the region 28 and furthermore may be situated at each location where a straight section of the side wall 16 joins a curved corner section thereof. The curved metallic portions of the frame means at the curved corner sections are fixed to each other at each of these corner sections by a suitably curved spacer plate 74 as illustrated in FIG. 2.

FIGS. 2 and 3 show also a fabric pocket structure 76 which may be joined at its top end to the inner surface of the peripheral side wall 16 and which has a suitable slide fastener closure 78.

Because of the relatively thin rectangular cross section of the substantially rigid frame portions and plastic coverings for the latter, the frame means 24 occupies only a very small amount of the interior space surrounded by the side wall 16. Furthermore, the springs such as the springs 38, 58, etc. are relatively flat and maintained in the same plane as the substantially rigid frame portions so that no additional space is undesirably occupied by the spring means. Furthermore, because of the construction of the extensions 44 and 46 of each spring means and the manner in which they are held in the grooves such as the grooves 48 and 50 shown in FIG. 6, the spring means of the invention opposes any tendency of the pair of adjoining frame portions interconnected thereby to twist one with respect to the other and also oppose any tendency of the frame portions to be deflected out of the plane occupied by the other of the frame portions.

This operation is shown in FIG. 5, for example, where the left frame portion is shown in phantom lines deflected in a clockwise direction with respect to the right frame portion. As soon as the force providing this type of deflection terminates, the spring means will automatically return the structure to its initial condition.

The same is true of an impact or crushing force acting in the manner shown in FIG. 7, according to which the article of luggage normally has the condition shown in phantom lines and is distorted to the condition shown in solid lines in FIG. 7. As soon as this distorting force is terminated the luggage will automatically return to its initial condition as a result of the action of the spring means of the invention.

Thus, by way of the structure of the present invention the soft-sided luggage is not only given a certain degree of rigidity, but in addition it is capable of withstanding repeated impacts, crushing forces, and the like, while being capable of yielding thereto and automatically returning to its initial condition.

What is claimed is:

1. In an article of luggage, a luggage case having a peripheral side wall made of a flexible sheet material and having an inner surface directed toward the interior of the luggage case, and frame means engaging said side wall at said inner surface thereof and extending along said side wall for imparting a degree of rigidity thereto, said frame means including at each of a plurality of regions thereof a pair of substantially rigid frame portions respectively terminating in free ends which are spaced from and directed toward each other, and spring means operatively connected with said frame portions for urging them apart from each other to tend to increase the distance between said free ends thereof so that the article of luggage is capable of resiliently yielding at said side wall thereof in response to impacts, crushing forces, and the like.

2. The combination of claim 1 and wherein said portions of said frame means at each of said regions thereof normally extend along a given line bridging the space between said free ends of said frame portions, and said spring means acting on said frame portions not only to urge the latter apart from each other but also to yieldably maintain said frame portions along said line.

3. The combination of claim 2 and wherein said spring means acts on said frame portions at each region of said frame means to urge said frame portions apart from each other while also yieldably and resiliently opposing twisting of one of said frame portions with respect to the other.

4. The combination of claim 3 and wherein said spring means at each of said regions of said frame means includes a pair of legs which when said spring means is in an unstressed condition are substantially coplanar and situated at a given distance from each other greater than the distance between said free ends of said frame portions, and said legs of said spring means being situated at least in part between and in engagement with said free ends of said frame portions.

5. The combination of claim 4 and wherein said legs of said spring means extend transversely with respect to said frame portions laterally beyond the latter.

6. The combination of claim 5 and wherein said spring means has a coil portion situated laterally beyond said frame portions and forming an extension of said legs.

7. The combination of claim 5 and wherein said frame portions respectively have hollow interiors which respectively terminate in openings at said free ends of said frame portions, and said legs of said spring means respectively having elongated extensions projecting respectively into said hollow interiors of said frame portions through said open ends thereof.

8. The combination of claim 7 and wherein each of said extensions at each leg of said spring means is of a substantially looped configuration.

9. The combination of claim 8 and wherein each frame portion has at its hollow interior an inner surface formed with a pair of opposed grooves respectively receiving opposed regions of each extension.

10. The combination of claim 1 and wherein said side wall has curved corner sections and elongated straight sections extending between and forming continuations of said curved corner sections, and said side wall having a pair of opposed edge portions each extending peripherally along said side wall, said regions of said frame means including at least a pair of regions situated adjacent said edge portions of said side wall substantially at a location where a straight section thereof joins a curved corner section thereof, and said frame means including at each of said pair of regions a straight frame portion extending along said straight section and a curved frame portion extending along said curved section with said straight and curved portions at each region of said frame means having said free ends which are urged apart from each other by said spring means.

11. The combination of claim 10 and wherein said frame means includes a plurality of said frame portions extending along said inner surface of said side wall adjacent said edge portions thereof, and a plurality of spacer plates extending between and interconnecting those frame portions which extend along one of said edge portions of said side wall to those frame portions which extend along the other edge portion of said side wall.

12. The combination of claim 10 and wherein each spring means includes a pair of legs extending between free ends of said pair of frame portions at each region of said frame means and engaging said free ends to urge them apart from each other, a pair of said spring means at said pair of regions being opposed to each other and extending laterally from the free ends of said frame portions at each region toward each other.

* * * * *